US012383084B2

(12) United States Patent
Samuels et al.

(10) Patent No.: US 12,383,084 B2
(45) Date of Patent: Aug. 12, 2025

(54) CONTAINER

(71) Applicant: NOVELLI INC., Chicago, IL (US)

(72) Inventors: Louis Samuels, Zionsville, IN (US); Craig Pinker, Auckland (NZ)

(73) Assignee: Novelli Inc., Chicago, IL (US)

( * ) Notice: Subject to any disclaimer, the term of this patent is extended or adjusted under 35 U.S.C. 154(b) by 0 days.

(21) Appl. No.: 18/215,169

(22) Filed: Jun. 27, 2023

(65) Prior Publication Data

US 2025/0000285 A1 Jan. 2, 2025

(51) Int. Cl.

| | |
|---|---|
| ***A47G 19/22*** | (2006.01) |
| ***A63H 33/10*** | (2006.01) |
| ***B65D 25/28*** | (2006.01) |
| ***B65D 81/36*** | (2006.01) |

(52) U.S. Cl.

CPC ..... *A47G 19/2205* (2013.01); *A63H 33/101* (2013.01); *B65D 25/2888* (2013.01); *B65D 81/361* (2013.01); *B65D 2203/00* (2013.01)

(58) Field of Classification Search

CPC ..... A47G 19/2205; B65D 81/361; B65D 25/2888; B65D 2203/00; A63H 33/101

USPC ..... 206/217, 579

See application file for complete search history.

(56) References Cited

U.S. PATENT DOCUMENTS 3,704,892 A * 12/1972 Moravick ..... A63F 9/12 273/157 R
6,382,411 B1 * 5/2002 Wentling ..... A47J 41/0083 206/217
7,252,204 B1 * 8/2007 Small ..... E05B 37/02 215/208
2002/0185388 A1 * 12/2002 Su ..... A47G 19/2227 206/217
2003/0173738 A1 * 9/2003 Simmons ..... A63F 9/001 273/153 S
2005/0194738 A1 * 9/2005 Simmons ..... A63F 9/001 273/153 S
2007/0029213 A1 * 2/2007 Hall ..... B65D 83/0454 206/217
2012/0018949 A1 * 1/2012 Fletcher ..... A63F 9/1044 273/157 R
2015/0310785 A1 * 10/2015 Shadduck ..... G09F 23/02 220/592.24
2016/0023796 A1 * 1/2016 Mangum ..... B65D 1/165 220/669
2017/0305100 A1 * 10/2017 Tan ..... B32B 7/12

* cited by examiner

*Primary Examiner* — Rafael A Ortiz
(74) *Attorney, Agent, or Firm* — William H. Honaker; Dickinson Wright PLLC

(57) ABSTRACT

A cup with an internal sleeve, and an external decorative sleeve made of connector bricks and a base. The internal sleeve has a hollow interior to form a cup to contain liquids if desired. The internal sleeve has a first end and a second end, and a first connector at the second end. The base has a second connector for connecting the base to the first connector of the sleeve. The external decorative sleeve is defined by a plurality of clamp bricks having a first bed with studs, and a second bed with recesses, the studs being capable of receipt into the recesses to interconnect the bricks to form an external decorative sleeve. The invention also includes the method of assembling and disassembling the cup into the internal sleeve, the base and the bricks.

11 Claims, 5 Drawing Sheets

CONTAINER

TECHNICAL FIELD

This invention relates generally to cups or containers and more specifically to a novelty cup that can be assembled by the user.

BACKGROUND OF THE INVENTION

It is desirable to provide a cup that is not only capable for holding something, like objects, such as pens and pencils or liquids but also to provide entertainment for the user by allowing the user to assemble and disassemble the cup.

SUMMARY OF THE INVENTION

In general terms, this invention provides a cup that is functional and entertaining. The cup has a sleeve with a hollow interior, a first end and a second end, and a first connector at the second end. A base has a second connector for connecting the base to the first connector of the sleeve. An external decorative sleeve is positioned over the sleeve. The external decorative sleeve is created from a plurality of clamp bricks having a first bed with studs, and a second bed with recesses, the studs are inserted into the recesses to interconnect the bricks to form the external decorative sleeve.

The cup in the disclosed embodiment has a sleeve with a rim at the first end. The rim as disclosed includes a recess for accepting the top row of clamp bricks. As disclosed, the first and second connectors are threaded and mate together to connect the sleeve to the base. The sleeve can also include a handle.

The clamp bricks as shown in the drawings have internal and external stretcher faces with the internal and external stretcher faces being curved. The stretcher faces can also include an image on at least one of said clamp bricks.

A method of assembling a cup is disclosed that includes providing a plurality of clamp bricks having a first bed with studs, and a second bed with recesses, the studs being capable of receipt into the recesses to interconnect the bricks to form an external decorative sleeve. Assembling the bricks to form the outer sleeve includes the steps of creating a starter course of clamp bricks on the base by selecting clamp bricks from the plurality of clamp bricks, positioning a brick over the studs, and inserting the studs into the recesses and repeating until the starter course is complete. Then creating a course of bricks over the starter course by selecting clamp bricks from the plurality of clamp bricks, positioning a brick over the studs of the bricks in the starter course and inserting the studs into the recesses and repeating until that course is complete. This process is repeated to create courses of bricks until the decorative external sleeve is assembled. The internal sleeve is inserted in the decorative external sleeve and connected to the base.

In the disclosed embodiment, the first and second connectors are threaded and the step of connecting the base to the sleeve includes the step of threading the first and second connectors together.

In the disclosed embodiment, the sleeve has a rim, and the rim has a recess. The step of inserting the sleeve into the external sleeve includes the step of inserting the uppermost bricks of the external sleeve into the recess.

The external sleeve can also include images and the step of assembling the bricks includes selecting and positioning bricks with partial images to correctly form the full image.

The bricks can be assembled in a running bond style wherein the bricks are staggered by ½ brick from the course above and below, in an one-over-two pattern. They can also have other arrangements, such as for example the stack bond where the stretcher bricks are laid in a grid of identical courses. In the stack bond, the joints are not staggered between courses.

To disassemble the cup, the sleeve is disconnected from the base. As disclosed, the sleeve is twisted to unthread the internal threads from the external threads. The sleeve is then removed from the decorative external sleeve. The bricks can be disassembled by removing the studs from the recesses.

These and other features and advantages of this invention will become more apparent to those skilled in the art from the detailed description of a preferred embodiment. The drawings that accompany the detailed description are described below.

DETAILED DESCRIPTION OF A PREFERRED EMBODIMENT

Figure 1:
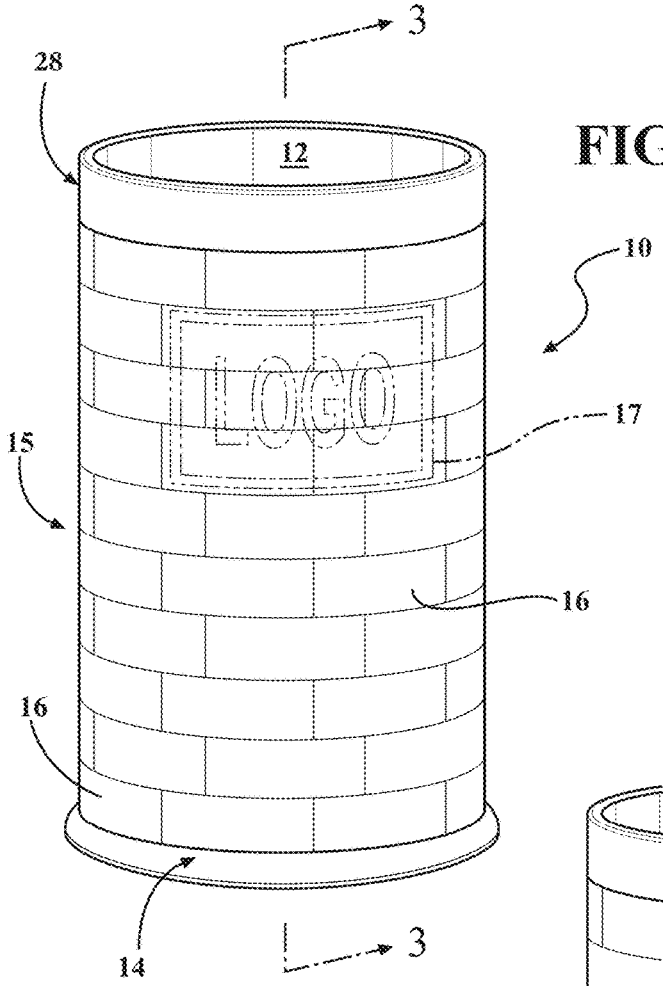
FIG. 1 is a perspective view of a first embodiment of the cup.

The novelty container or cup of the present invention is shown generally at 10. The cup has an internal sleeve 12 which is shown as a tube, a base 14 and clamp bricks 16 which can be interconnected to form a decorative external sleeve 15 shown as a tube that fits over the internal sleeve 12.

Clamp bricks 16 are assembled to create the decorative external sleeve 15. The bricks 16 as disclosed are made of molded plastic and have top and bottom beds 18, ends or header faces 20 and sides or stretcher faces 22. As illustrated the stretcher faces 22 are radial stretcher faces wherein the stretcher faces are curved in a mirror like fashion. It should be understood that the outer stretcher face 22 could be flat i.e., not radiused to provide a different appearance. For example, the outside stretcher face could be flat to create a box like structure or have other shapes to create, for example, raised surfaces or triangular surfaces, etc. The outer stretcher faces could also have images 17 on them that require the pieces to be correctly positioned to create the image, like a puzzle. The image could be any type of image including a corporate logo for example.

The beds 18 of the clamp bricks 16 have studs 24 protruding from one bed 18 and mating recesses 26 in the opposite bed 18 so that the clamp bricks 16 can be interconnected to form a unitary decorative external sleeve 15.

Figure 2:
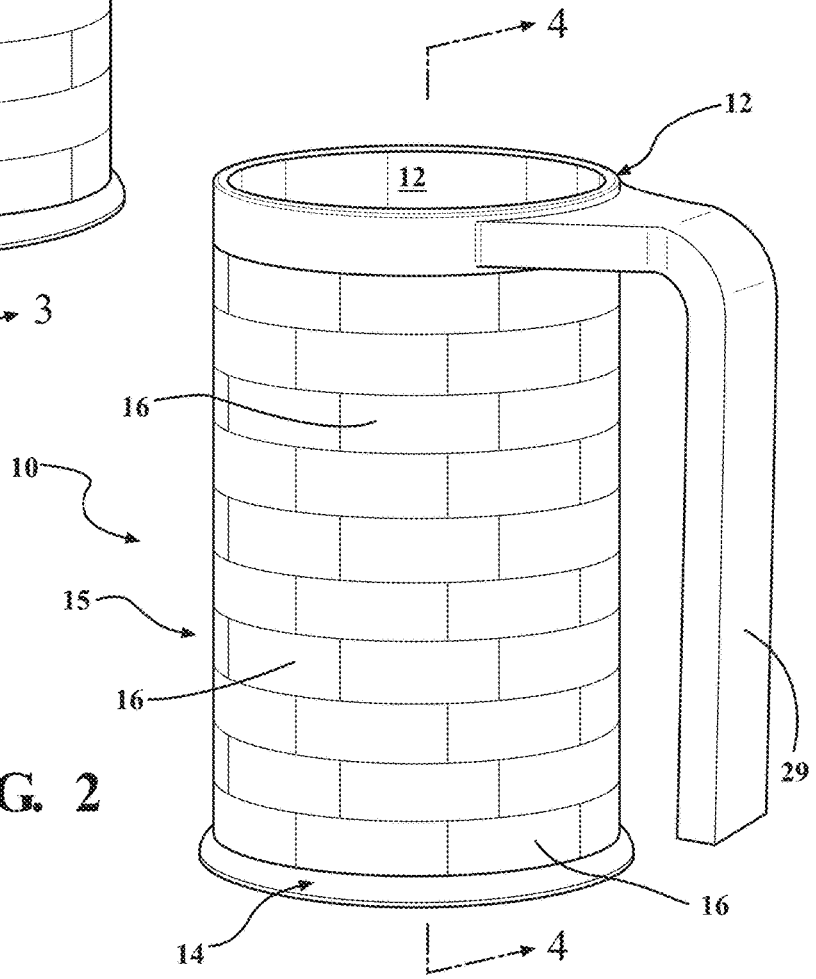
FIG. 2 is a perspective view of a second embodiment of the cup.
Figure 3:
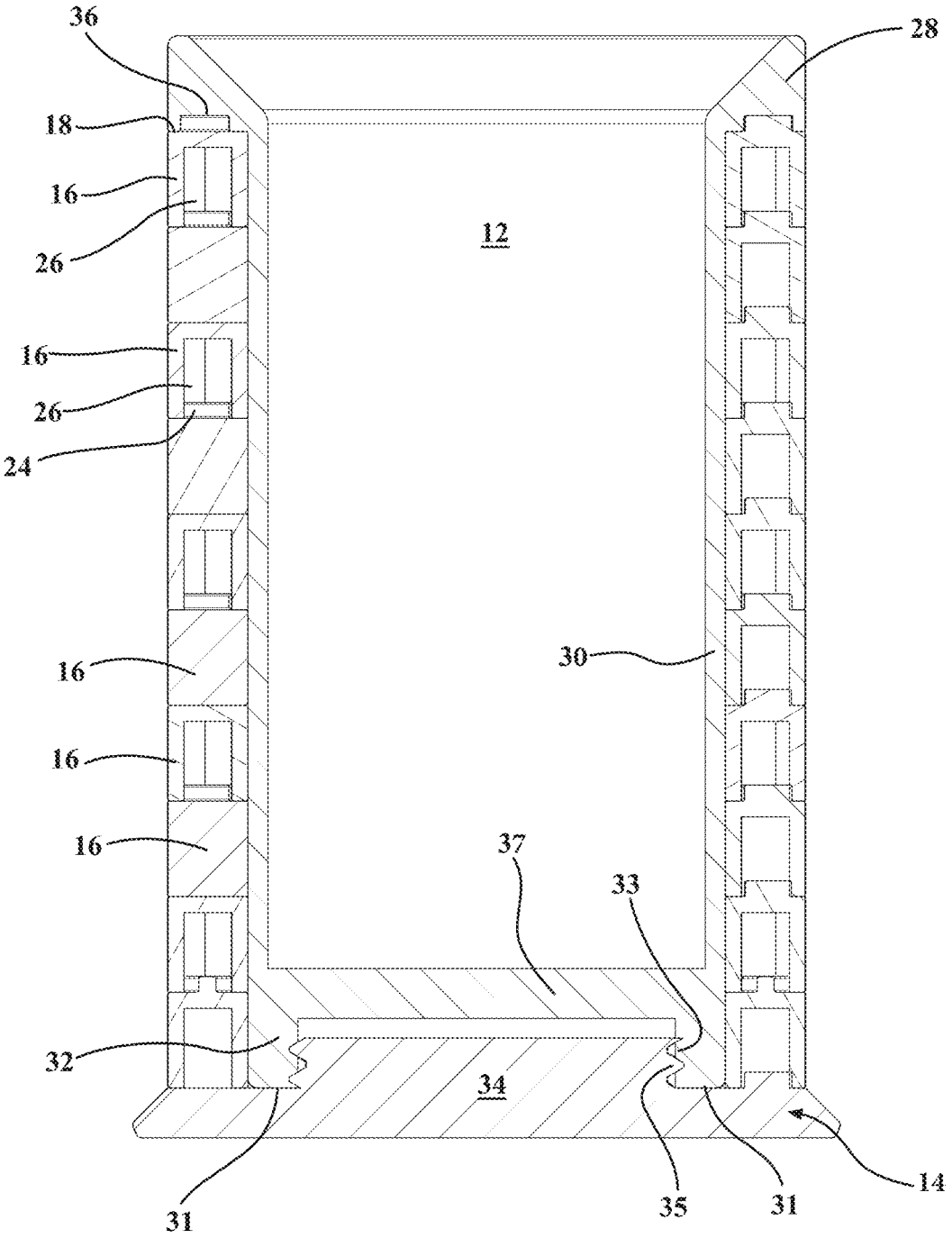
FIG. 3 is a cross section taken along 3-3 of FIG. 1.
Figure 4:
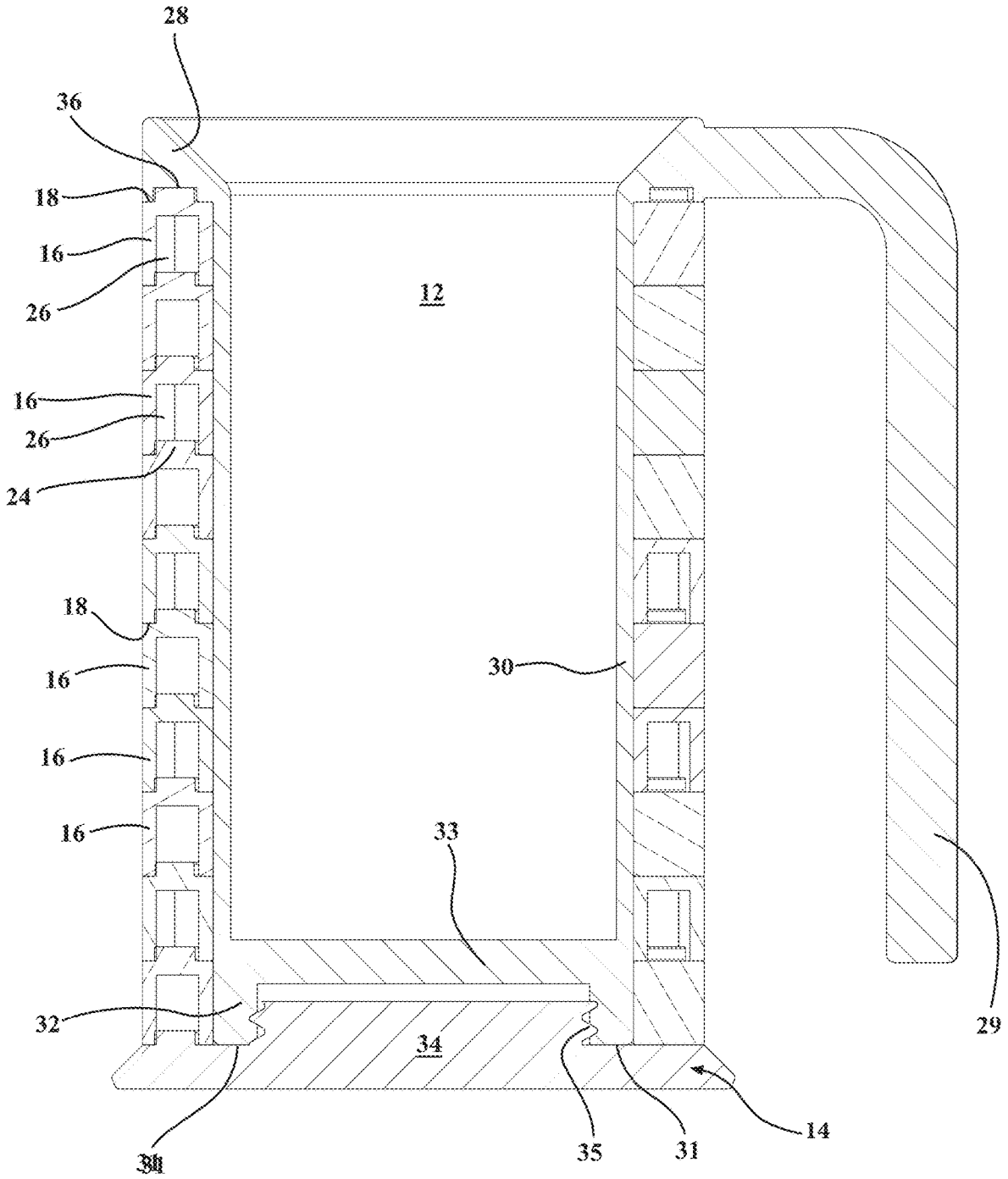
FIG. 4 is a cross section taken along 4-4 of FIG. 2.
Figure 5:
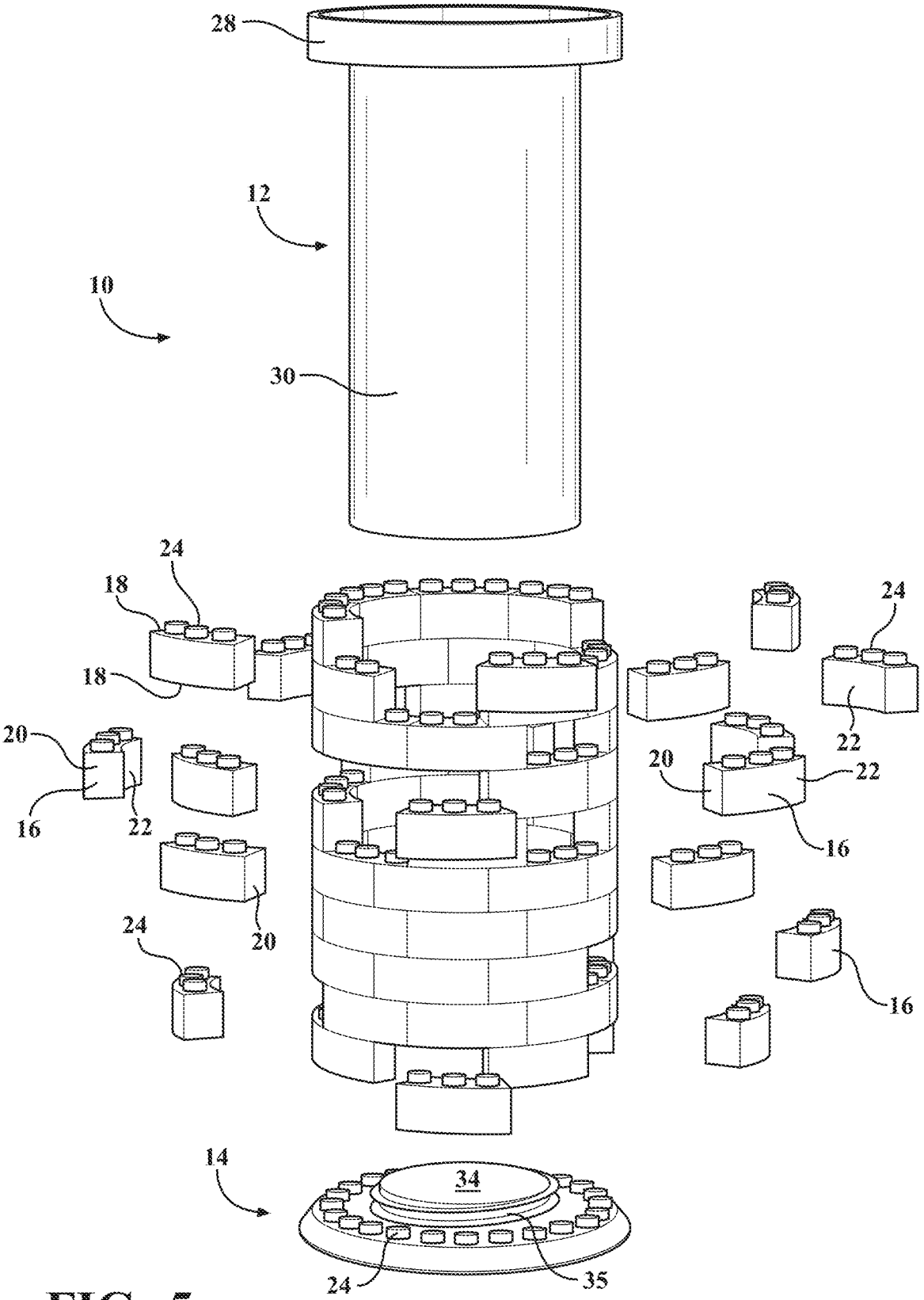
FIG. 5 is an exploded view of the first embodiment.
Figure 6:
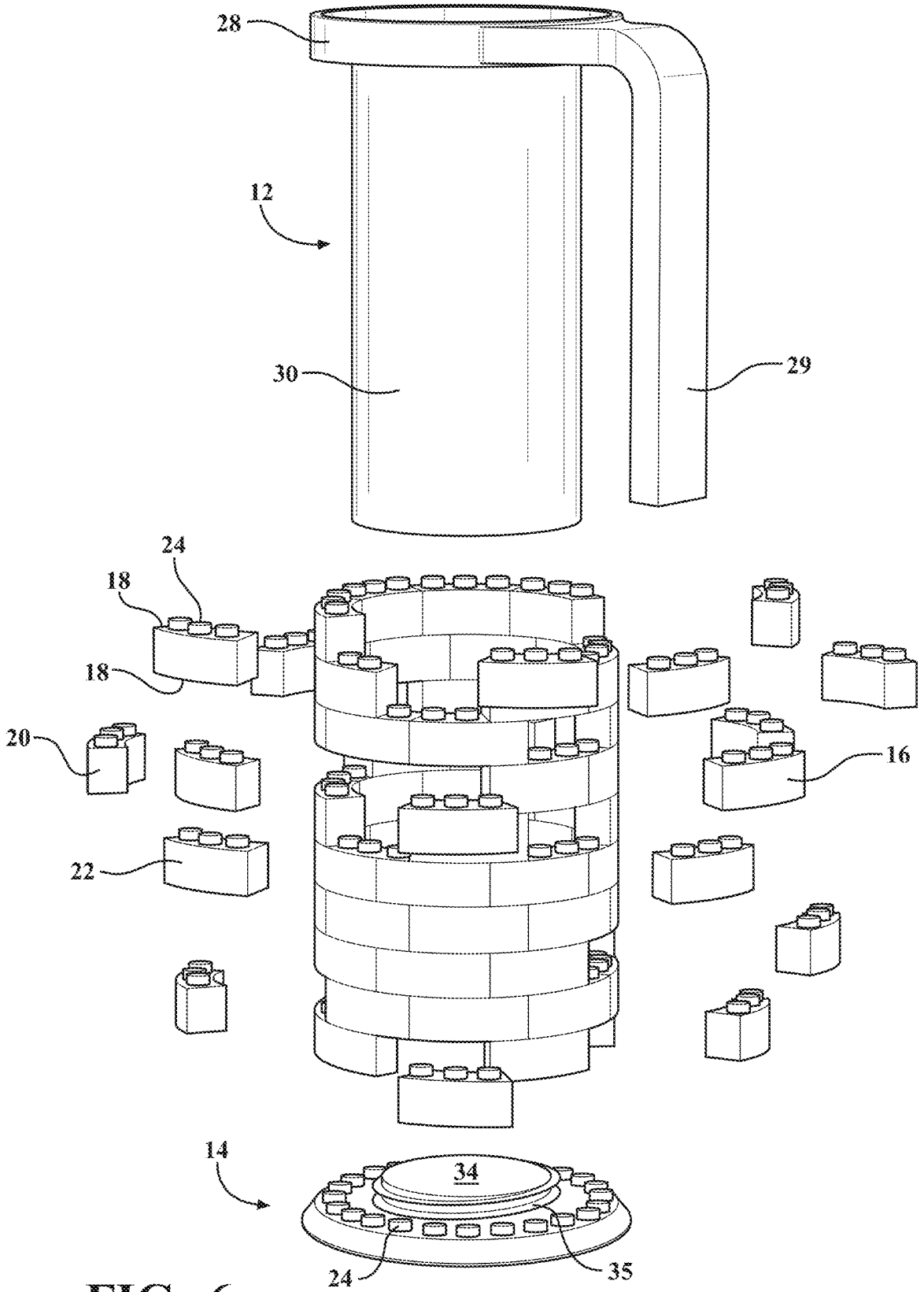
FIG. 6 is an exploded view of the second embodiment.

The sleeve 12 includes a rim 28 and body 30. As shown in FIGS. 2,4, and 6, the rim can also include a handle 29. The end 31 of the body 30 has a first connector 32 which connects with a second connector 34 to join the sleeve 12 with the base 14. As illustrated, the sleeve 12 has a bottom 37 spaced from the end 31. In the disclosed embodiment, the first connector 32 has internal threads 33 for threading onto the second connector 34 on base 14. The connector 34 on base 14 has external threads 35 on second connector 34 which mates with the internal threads of connector 32.

Other types of connectors can be used, for example, a snap fit or friction fit connection could be used to connect the sleeve 12 to the base 14. In addition, the connectors 32 and 34 could have the threads 33 and 35 reversed. The threads 33 could be on the outside of the sleeve 12 and the second connector 34 could have internal threads 35.

As disclosed, the rim 28 on the sleeve 12 has a recessed portion 36 which receives the studs 24 of the clamp bricks 16 adjacent the rim 28 when the cup or container 10 is assembled. The width of the recess 36 is slightly larger than studs 24 so that the clamp bricks 16 can be inserted into the recessed portion 36 of rim 28 for a clean or more finished look.

The base 14 has a series of studs 24 positioned in a circular pattern to receive the recesses 26 in the adjacent beds 18 of the clamp bricks 16.

To assemble the cup or container 10, the user selects clamp bricks 10 and clamps them to the base 14. As illustrated, the starter course of the bricks 10 would be positioned over the studs 24 and the studs 24 inserted into the corresponding recesses 26. The second layer of bricks 10 would be assembled over the starter course and the process repeated until the decorative external sleeve 15 is completed. It should be appreciated that with images on the decorative external sleeve 15, the correct bricks would need to be selected and positioned correctly for the logo to correctly appear. It should also be appreciated that the bricks 16 as shown are in the running bond style where the bricks are staggered by ½ brick from the course above and below, in a classic one-over-two pattern. They can also have other arrangements, such as for example the stack bond where the stretcher bricks are laid in a grid of identical courses. In the stack bond, the joints are not staggered between courses.

Once the bricks are laid, the sleeve 12 is inserted into the external sleeve 15 and connected to the base 14. As disclosed, the sleeve 12 is inserted and twisted to thread the internal threads 33 onto the external threads 35. As disclosed, the studs 24 of the top bricks are received into the recessed portion 36 of the rim 28.

To disassemble, the sleeve 12 is disconnected from the base 14. As disclosed, the sleeve is twisted to unthread the internal threads 33 from the external threads 35. The sleeve 12 is removed from the decorative external sleeve 15. The bricks 16 can then be disassembled by removing the studs 24 from the recesses 26.

It should be appreciated by those of ordinary skill in this art that the overall shape of the cup or container 10 could be different than the tubular shape shown. The shape could for example be square, rectangular, triangular, oblong, etc.

The foregoing invention has been described in accordance with the relevant legal standards, thus the description is exemplary rather than limiting in nature. Variations and modifications to the disclosed embodiment may become apparent to those skilled in the art and do come within the scope of the invention. Accordingly, the scope of legal protection afforded this invention can only be determined by studying the following claims.

What is claimed is:

1. A cup comprising:

a sleeve having a hollow interior, a first end and a second end, and a first connector at said second end;

a base having a second connector for connecting said base to said first connector of said sleeve;

an external decorative sleeve defined by a plurality of clamp bricks having a first bed defined by four sides with studs protruding from said first bed, said studs each having an exterior surface that is spaced from and doesn't extend to any of said four sides, and a second bed with recesses, said studs being capable of receipt into said recesses to interconnect said bricks to form said external decorative sleeve with said unitary external decorative sleeve being free standing and interconnected to form a unitary external decorative sleeve;

wherein said sleeve has a rim at said first end; and wherein said rim has a recess capable of accepting said studs of said clamp bricks.

2. The cup of claim 1, wherein said first and second connectors are threaded and mate together to connect said sleeve to said base.

3. The cup of claim 1, wherein said clamp bricks have internal and external stretcher faces.

4. The cup of claim 3, wherein said internal and external stretcher faces are curved.

5. The cup of claim 1, wherein said sleeve includes a handle.

6. The cup of claim 1, further including an image on at least one of said clamp bricks.

7. The cup of claim 3, further including an image on said external stretcher face of at least one of said clamp bricks.

8. The cup of claim 1, wherein said sleeve and said decorative external sleeve are tubes.

9. A cup comprising:

a sleeve having a hollow closed interior, a first end and a second end, and a first connector at said second end;

a base having a second connector for connecting said base to said first connector of said sleeve;

said first and second connectors have mating threads configured to be threaded and mate together to connect said sleeve to said base;

an external decorative sleeve defined by a plurality of clamp bricks having a first bed with studs, and a second bed with recesses, said studs being capable of receipt into said recesses to interconnect said bricks to form said external decorative sleeve;

wherein said sleeve has a rim at said first end; and wherein said rim has a recess capable of accepting said studs of said clamp bricks.

10. The cup of claim 9, wherein said clamp bricks have internal and external stretcher faces, said internal and external stretcher faces are curved.

11. The cup of claim 10, further including an image on said external stretcher face of at least one of said clamp bricks.

* * * * *